US007089081B2

(12) United States Patent
Palmgren

(10) Patent No.: US 7,089,081 B2
(45) Date of Patent: Aug. 8, 2006

(54) MODELING AN ABRASIVE PROCESS TO ACHIEVE CONTROLLED MATERIAL REMOVAL

(75) Inventor: Gary M. Palmgren, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 109 days.

(21) Appl. No.: 10/355,659

(22) Filed: Jan. 31, 2003

(65) Prior Publication Data

US 2004/0153197 A1 Aug. 5, 2004

(51) Int. Cl.
*G06F 11/00* (2006.01)

(52) U.S. Cl. ..... 700/175; 700/164; 700/172; 451/6; 451/21; 451/22

(58) Field of Classification Search ..... 700/175, 700/172, 164; 451/21, 22, 6
See application file for complete search history.

(56) References Cited

U.S. PATENT DOCUMENTS

| | | | | |
|---|---|---|---|---|
| 3,656,265 A | | 4/1972 | Schaffner, Jr. | |
| 4,212,135 A | | 7/1980 | Mirsch et al. | |
| 4,351,029 A | | 9/1982 | Maxey et al. | |
| 4,505,074 A | * | 3/1985 | Kogure | 451/5 |
| 4,535,571 A | * | 8/1985 | Smith | 451/5 |
| 4,590,573 A | * | 5/1986 | Hahn | 700/164 |
| 4,900,252 A | | 2/1990 | Liefke et al. | |
| 5,012,989 A | | 5/1991 | Whyte, Jr. et al. | |
| 5,152,917 A | | 10/1992 | Pieper et al. | |
| 5,177,901 A | | 1/1993 | Smith | |
| 5,441,549 A | | 8/1995 | Helmin | |
| 5,452,150 A | | 9/1995 | Henneberger et al. | |
| 5,490,878 A | | 2/1996 | Peterson et al. | |
| 5,508,596 A | | 4/1996 | Olsen | |
| 5,514,028 A | | 5/1996 | Ali et al. | |
| 5,609,718 A | * | 3/1997 | Meikle | 438/14 |
| 5,643,044 A | | 7/1997 | Lund | |
| 5,661,616 A | | 8/1997 | Tran et al. | |
| 5,725,421 A | | 3/1998 | Goers et al. | |
| 5,738,574 A | * | 4/1998 | Tolles et al. | 451/288 |

(Continued)

FOREIGN PATENT DOCUMENTS

DE 35 18 902 A1 11/1986

(Continued)

OTHER PUBLICATIONS

U.S. Appl. No. 10/115,538, filed Apr. 3, 2002, Abrasive Articles and Methods for the Manufacture and Use of Same.

*Primary Examiner*—Leo Picard
*Assistant Examiner*—Michael D. Masinick

(57) ABSTRACT

In general, techniques are described that allow an abrasive manufacturing process to achieve a controlled performance parameter, e.g., an amount of material removal, without requiring the use of feedback controls within the abrasive manufacturing process. For example, a system includes a machine to abrade a workpiece with an abrasive article, and a controller to control the application of the abrasive article to the workpiece by the machine to achieve a substantially constant cut rate for the abrasive article. The controller controls one or more process variables in accordance with an open-loop mathematical model that relates the cut rate of the abrasive article to an application force of the abrasive article to achieve controlled material removal. For example, a constant rate of cut can be achieved or a fixed amount of material can be removed while abrading one or more workpiece in accordance with the model.

51 Claims, 6 Drawing Sheets

U.S. PATENT DOCUMENTS

| | | | | |
|---|---|---|---|---|
| 5,833,519 | A * | 11/1998 | Moore | 451/56 |
| 5,897,424 | A | 4/1999 | Evans et al. | |
| 6,000,997 | A * | 12/1999 | Kao et al. | 451/7 |
| 6,123,612 | A | 9/2000 | Goers | |
| 6,264,533 | B1 | 7/2001 | Kummeth et al. | |
| 6,286,656 | B1 | 9/2001 | Huang et al. | |
| 6,293,139 | B1 | 9/2001 | Keller et al. | |
| 6,322,427 | B1 * | 11/2001 | Li et al. | 451/56 |
| 6,475,253 | B1 | 11/2002 | Culler et al. | |
| 6,488,575 | B1 | 12/2002 | Agarwal et al. | |
| 6,564,116 | B1 | 5/2003 | Wang et al. | |
| 6,612,917 | B1 | 9/2003 | Bruxvoort | |
| 2002/0106971 | A1 | 8/2002 | Rodriquez et al. | |
| 2002/0142706 | A1 * | 10/2002 | Glashauser et al. | 451/41 |

FOREIGN PATENT DOCUMENTS

| | | | |
|---|---|---|---|
| DE | 41 11 016 | C1 | 7/1992 |
| EP | 0 447 084 | B1 | 5/1994 |
| EP | 0 630 820 | A1 | 12/1994 |
| EP | 0 881 552 | A2 | 12/1998 |
| EP | 0 893 203 | A2 | 1/1999 |
| EP | 1 063 056 | A2 | 12/2000 |
| EP | 1 099 511 | A2 | 5/2001 |
| WO | WO 99/23449 | | 5/1999 |
| WO | WO 00/35628 | | 6/2000 |

* cited by examiner

MODELING AN ABRASIVE PROCESS TO ACHIEVE CONTROLLED MATERIAL REMOVAL

TECHNICAL FIELD

The invention relates to fixed abrasive articles and, in particular, techniques for controlling abrasive manufacturing processes.

BACKGROUND

An abrasive manufacturing process involves the application of an abrasive article to a workpiece to polish, grind, or otherwise remove material from the workpiece. In many processes it is desirable to control the amount of material removed from a workpiece. It is, for example, often desirable to remove material at a constant rate, i.e., to achieve a constant rate of cut with the abrasive article. That is, it is often desirable to remove a relatively constant amount of material from the workpiece over a period of time. In other cases, it is desirable to remove a fixed amount of material from a workpiece. In either case, it is desirable to control the amount of material removed even as the abrasive article wears.

One common way for controlling the amount of material removed from a workpiece is to force the abrasive article into the workpiece at a constant rate. In other words, a machine may be used within the process to physically move the abrasive article into the workpiece at predefined increments. These machines often tend to be heavy, rigid machines that are expensive to construct and maintain. Moreover, such machines are limited to well-defined workpiece geometries, and can easily damage a workpiece. The workpiece may be damaged, for example, if the machine unexpectedly contacts the workpiece while rapidly advancing the abrasive article.

Other abrasive manufacturing processes make use of feedback controls, either manual or automated, to control the amount of material removed from a workpiece. For example, some abrading machines incorporate sensors to measure an amount of material removed from the workpiece, and may adjust process variables, e.g., an application force of the abrasive article, coolant flow, an abrasion time, a velocity of the abrasive article relative to the workpiece, and the like, based on the measurements. Alternatively, an operator may measure the abraded workpiece or the removed material, and make manual adjustments to one or more process variables based on the measurements in an attempt to achieve a constant rate of cut of the workpiece.

In general, the use of manual measurements and adjustments is prone to error, and can easily lead to the production of unacceptable workpieces. The use of feedback loops and automated controls, however, can add significant expense to an abrasive manufacturing process. Moreover, such systems may be limited to particular types of workpieces, and may not easily be used on different types of workpieces.

SUMMARY

In general, the invention is directed to techniques that allow an abrasive manufacturing process to achieve a controlled performance parameter, e.g., a controlled amount of material removal, without relying on the use of closed-loop feedback within the process. More particularly, the controlled material removal can be achieved by mathematically modeling the cut rate of the abrasive article, and controlling the abrasive manufacturing process in accordance with the model.

The term abrasive article as used herein generally refers to a fixed abrasive article, i.e., an abrasive article in which abrasive particles are fixedly attached to a substrate. Abrading with a fixed abrasive is sometimes referred to in the technical literature as two body grinding where the abrasive article is one body and the workpiece from which material is abraded is the second body. In general, techniques are described for controlling the application of a fixed abrasive article and compensating for wear of the abrasive article by a predetermined model of the abrasive wear to achieve a controlled performance.

In one embodiment, the invention is directed to a method comprising generating an open-loop model of a cut rate of an abrasive article when applied to a type of workpiece over an abrading period, and abrading a workpiece of the workpiece type with the abrasive article in accordance with the model to achieve a substantially constant cut rate.

In another embodiment, the invention is directed to a system comprising a machine to abrade a workpiece with an abrasive article, and a controller to control the application of the abrasive article to the workpiece by the machine to achieve a substantially constant cut rate for the abrasive article.

In another embodiment, the invention is directed to a computer-readable medium comprising instructions to cause a programmable controller to direct a machine to abrade a workpiece with an abrasive article to achieve a substantially constant cut rate for the abrasive article over an abrading period.

In another embodiment, the invention is directed to a computer-readable medium comprising data representing a model for use by a machine to abrade a workpiece with an abrasive article to achieve a substantially constant cut rate for the abrasive article over an abrading period.

In another embodiment, the invention is directed to a method comprising generating an open-loop model of a cut rate of an abrasive article when applied to a type of workpiece over an abrading period; and abrading a workpiece of the workpiece type with the abrasive article in accordance with the model to achieve a controlled amount of material removed from the workpiece during the abrading period.

In another, the invention is directed to a method comprising generating an open-loop model of a cut rate of an abrasive article when applied to a type of workpiece over an abrading period; and abrading a plurality of workpieces of the workpiece type with the abrasive article for varying time periods in accordance with the model to remove a constant amount of material from each workpiece.

In another embodiment, the invention is directed to a method comprising generating an open-loop model of a performance parameter of an abrasive article when applied to a type of workpiece over an abrading period, and abrading a plurality of workpieces of the workpiece type with the abrasive article for varying time periods in accordance with the model to achieve a substantially constant value for abrasive performance parameter over an abrading period. The performance parameter may comprise one of a cut rate of the abrasive article during the abrading period, an amount of material removed by the article during the abrading period, a surface finish achieved by the abrasive article, and a resultant geometry of the workpiece achieved by the abrasive article.

The invention may provide a number of advantages. For example, the techniques describe herein may be utilized within an abrasive manufacturing process to achieve a substantially controlled cut or finish without requiring the use of feedback controls within the abrasive manufacturing process. Moreover, the techniques may reduce the need for manual quality control measurements of the abraded workpiece, and manual adjustments to the abrasive manufacturing process.

In addition, the techniques may reduce any variability between workpieces. More specifically, the techniques may be used to model and compensate for wear to the abrasive article over a period of time. By automatically adjusting process variables, e.g., application force, based on the duration of use, the techniques can be used to more precisely abrade workpieces.

As another advantage, the techniques may allow an increased number of workpieces to be processed using a common abrasive article. For example, application of the techniques to achieve a substantially constant cut on a series of workpieces may reduce the time used for each workpiece during the initial stages of the abrasive's life, i.e., when the abrasive article is new, and the abrading time may be increased later in the life of the abrasive article. As a result, the abrasive article may experience reduced wear on the initial workpieces in comparison with conventional techniques that utilize a fixed abrading time for each workpiece throughout the life of the abrasive article.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
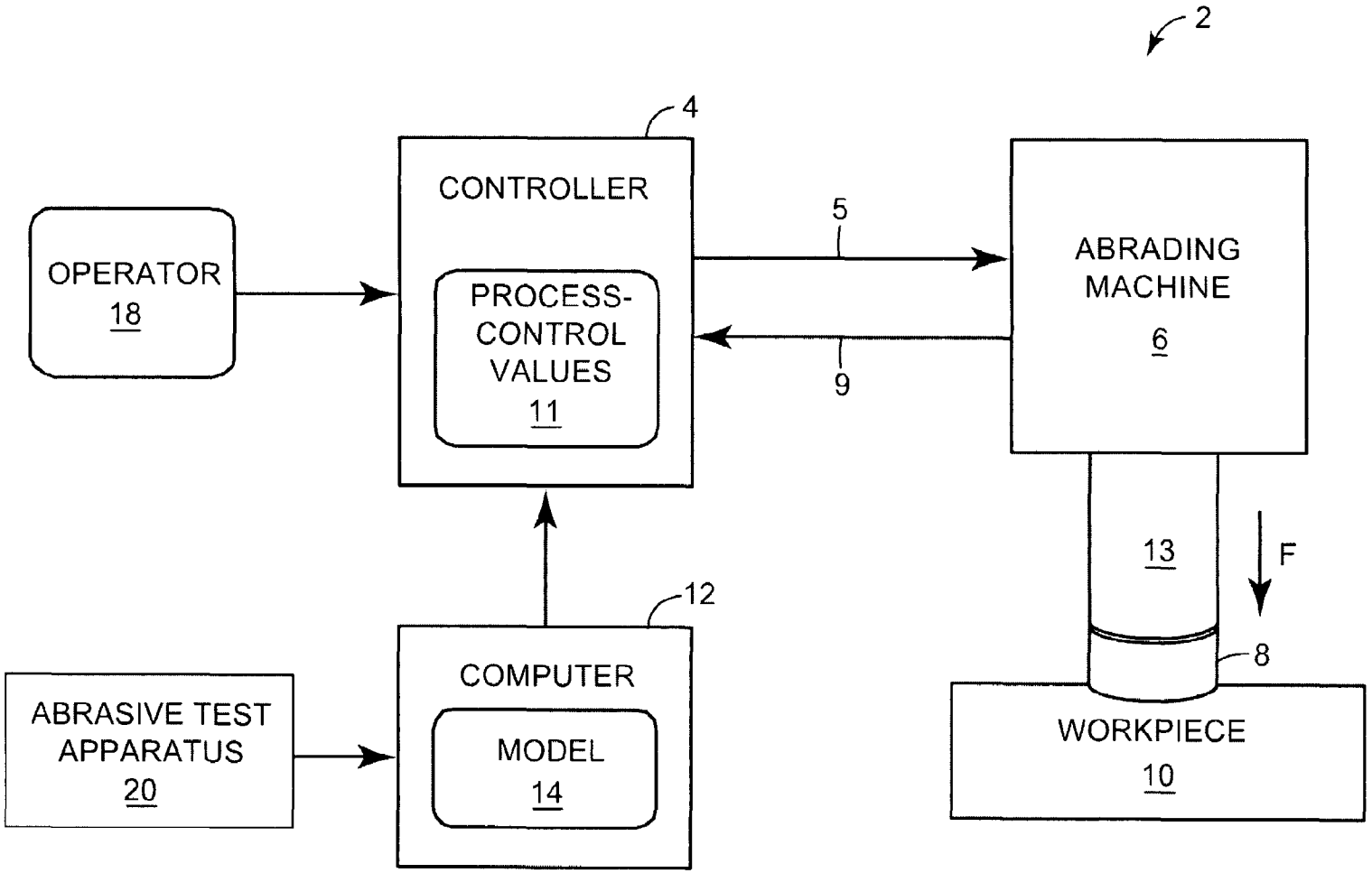
FIG. 1 is a block diagram of an abrasive manufacturing process that achieves a substantially constant rate of cut during an abrading period using a mathematical model for an abrasive article.

FIG. 1 is a block diagram of an abrasive manufacturing process 2 that achieves controlled material removal during an abrading period. Controller 4 provides control signals 5 to abrading machine 6 to control the application of abrasive article 8 to workpiece 10. In response to control signals 5, abrading machine 6 applies abrasive article 8 to workpiece 10 with relative movement to polish, grind, or otherwise abrade a surface of the workpiece.

Controller 4 outputs control signals 5 to control one or more process control parameters based on process control values 11. For example, controller 4 may output control signals 5 to control an application force (F) at which abrading machine 6 applies abrasive article 8 to workpiece 10. As another example, controller 4 may control a time period for abrading workpiece 10, an angular velocity at which rotatable shaft 13 of abrading machine 6 applies abrasive article 8, coolant flow rates, and other process settings based on process control values 11.

Controller 4 may receive process control values 11 from computer 12, which maintains an open-loop mathematical model 14 to compute the process control values. More specifically, computer 12 computes process control values 11 to control abrading machine 6 to achieve a desired abrasive performance, e.g., a substantially controlled cut during the abrading period. Mathematical model 14 is referred to as "open-loop" in the sense that the model does not rely on real-time feedback signals obtained while abrading workpiece 10. In other words, controller 4 and manufacturing process 2 may achieve controlled material removal without requiring real-time feedback. However, controller 4 may nevertheless utilize open-loop model 14 in conjunction with feedback signals 9. Process 2 may, for example, utilize feedback signals 9, in real time or delayed, to refine model 14, or to control other process control values not computed using the model.

As described herein, model 14 mathematically represents the cut rate of abrasive article 8 as a function of a length of time that the abrasive article has been applied to workpiece 10. Consequently, model 14 can be used to predict and compensate for the wear of abrasive article 8 over the abrading period. Based on this representation, computer 12 may utilize model 14 to calculate process control values 11 for use within the abrading period to control an amount of material removed from workpiece 10. For example, computer 12 may invoke model 14 to calculate process control values 11 for adjusting control signals 5 during the abrading period in order to achieve a constant cut rate during an abrading period, or to remove a target amount of material during the abrading period. Example process variables that may be controlled include an application force of abrasive article 8 against workpiece 10, an application velocity of abrasive article 8 relative to workpiece 10, a duration for the abrading period, a flow of one or more coolants, and the like.

The generation and use of model 14 may allow manufacturing process 2 to achieve a number of advantages over conventional systems. For example, abrasive manufacturing process 2 may achieve a substantially constant cut rate of workpiece 10, or removal of a target amount of material, without relying on the use of feedback controls. Moreover, the techniques may reduce the reliance on operator 18 during the abrading period. As an example, operator 18 need not make quality control measurements of abraded workpiece 10, and manually adjust process control values 16, as is common in some conventional abrasive manufacturing processes.

In addition, the techniques may reduce any variability between workpiece 10 and subsequent workpieces. More specifically, model 14 compensates for wear to the abrasive article 8 over a period of time. As a result, controller 4 and abrading machine 6 can utilize process control values 11 to drive process variables, e.g., application force (F), based on the duration of use of abrasive article 8. Consequently, abrasive article 8 can be reused in accordance with process control values 11 and model 14 to more precisely abrade a number of workpieces over an extended period. Controller 4 may compute durations to abrade each workpiece in accordance with model 14 to provide controlled material removal. For example, a constant rate of cut can be achieved or a fixed amount of material can be removed while abrading each of the workpieces in accordance with process control values 11 and model 14.

As a result, in some cases the techniques may actually extend the life of abrasive article 8. For example, application of process control values 11 to achieve a substantially controlled cut may reduce the application time used during the initial stages of the abrasive article's life, i.e., when abrasive article 8 is relatively new, and may be increased during the abrading period. In other words, the application time may be varied in accordance with process control values 11 while abrading workpiece 10, or subsequent workpieces, to achieve a substantially controlled cut. As a result, abrasive article 8 may experience reduced wear during the initial stages in comparison with conventional techniques that utilize a fixed abrading time throughout the abrasive article's life.

Abrasive manufacturing process 2 may take any of a variety of forms, and the techniques described herein are not limited to a particular type of abrasive manufacturing process. For example, abrasive manufacturing process 2 may by a chemical mechanical polishing (CMP) process for production of semiconductor wafers, camshaft and crankshaft dimensioning and finishing, roll surfacing, lapping, manufacturing fiber optic connectors and optical devices, and the like. Consequently, computer 12 may generate model 14 to achieve a substantially constant abrasive performance parameter of an abrasive article, e.g., cut rate, amount of material removed by the article, a surface finish, a workpiece geometry, and the like.

Similarly, the invention is not limited to a particular type of abrasive article 8. For example, abrasive article 8 may provide for grinding, fining, polishing, conditioning or otherwise abrading workpiece 10, and may take the form of an a belt, a pad, a disc, and the like. Moreover, abrasive article 8 may be constructed in any number of ways. For example, abrasive article 8 may include an abrasive surface coated onto a backing. The abrasive surface may include a binder, e.g., polymeric, ceramic, metallic, or the like, and usually includes abrasive particles that provide a desired surface finish to workpiece 10. The abrasive particles may be dispersed throughout the binder, solely along the outermost surface of the binder, or throughout the binder as well as along the outermost surface. The abrasive particles may comprise hard abrasive particles, and softer abrasive particles, including organic and inorganic particles.

Model 14 may be generated for abrasive article 8 using data collected over a period of time from abrading machine 6 of abrasive manufacturing process 2. Alternatively, model 14 may be generated using an abrasive test apparatus 20. Abrasive test apparatus 20 and computer 12 may be located offline from abrasive manufacturing process 2, but directly communicatively coupled, e.g., network, to controller 4. Alternatively, abrasive test apparatus 20, computer 12, or both, be maintained by a manufacturer of abrasive article 8. Abrasive test apparatus 20 and computer 12 may, for example, reside within a manufacturing plant where abrasive article 8 was produced, and may electronically communicate model 14, process control values 16, or both, to controller 4, e.g., via a private or public network.

Figure 2:
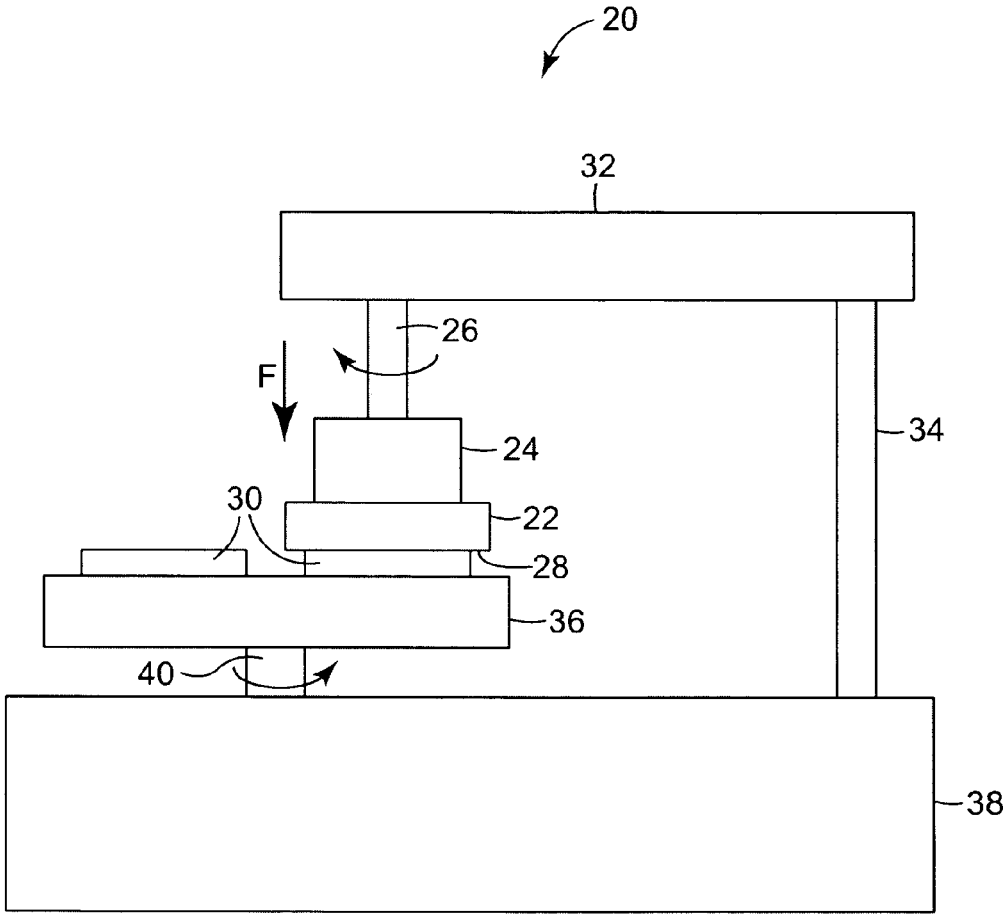
FIG. 2 is a schematic diagram illustrating an example abrasive test apparatus for use in generation of the model.

FIG. 2 is a schematic diagram illustrating an example abrasive test apparatus 20 for use in generation of model 14 for an abrasive article. As shown in FIG. 2, one or more workpieces 30 may be retained on platen 36. Abrasive article 22 is positioned within abrasive testing apparatus 20, and is retained via fixture 24 mounted to rotatable shaft 26. Consequently, abrasive article 22, fixture 24, and shaft 26 rotate via power supplied by a motor (not shown) within housing 32.

In the example embodiment, housing 32 may be driven vertically along a support shaft 34 to provide a means for engaging abrasive article 22 with workpiece 30 at a desired force (F). Abrasive surface 28 of abrasive article 22 may be positioned in direct contact with the surface of workpiece 30 to abrade a surface of workpiece 30. Platen 36 carries the workpiece 30 and helps maintain contact between workpiece 30 and the abrasive article 22. Platen 36 is rotatable about the axis of support shaft 40, which may be rotationally driven by a motor (not shown) housed within base 38. In this manner, abrasive article 22 and workpiece 30 may be rotated against one another under force (F) to abrade workpiece 30.

In operation, abrasive test apparatus 20 may serve as a test station to evaluate and characterize the cut rate of abrasive article 22 for use in determining model 14. In general, apparatus 20 may perform a sequence of representative abrasive operations to characterize the response to common processing parameters for abrasive article 22. To provide accurate data for use in abrasive manufacturing process 2, workpiece 30 and abrasive article 22 may be of the same types as workpiece 10 and abrasive article 8 of FIG. 1, respectively. Moreover, if apparatus 20 is not used inline as part of abrasive manufacturing process 2, e.g., abrading machine 10, common equipment and conditions may be used or simulated to further improve the accuracy of the collected data.

Figure 3:
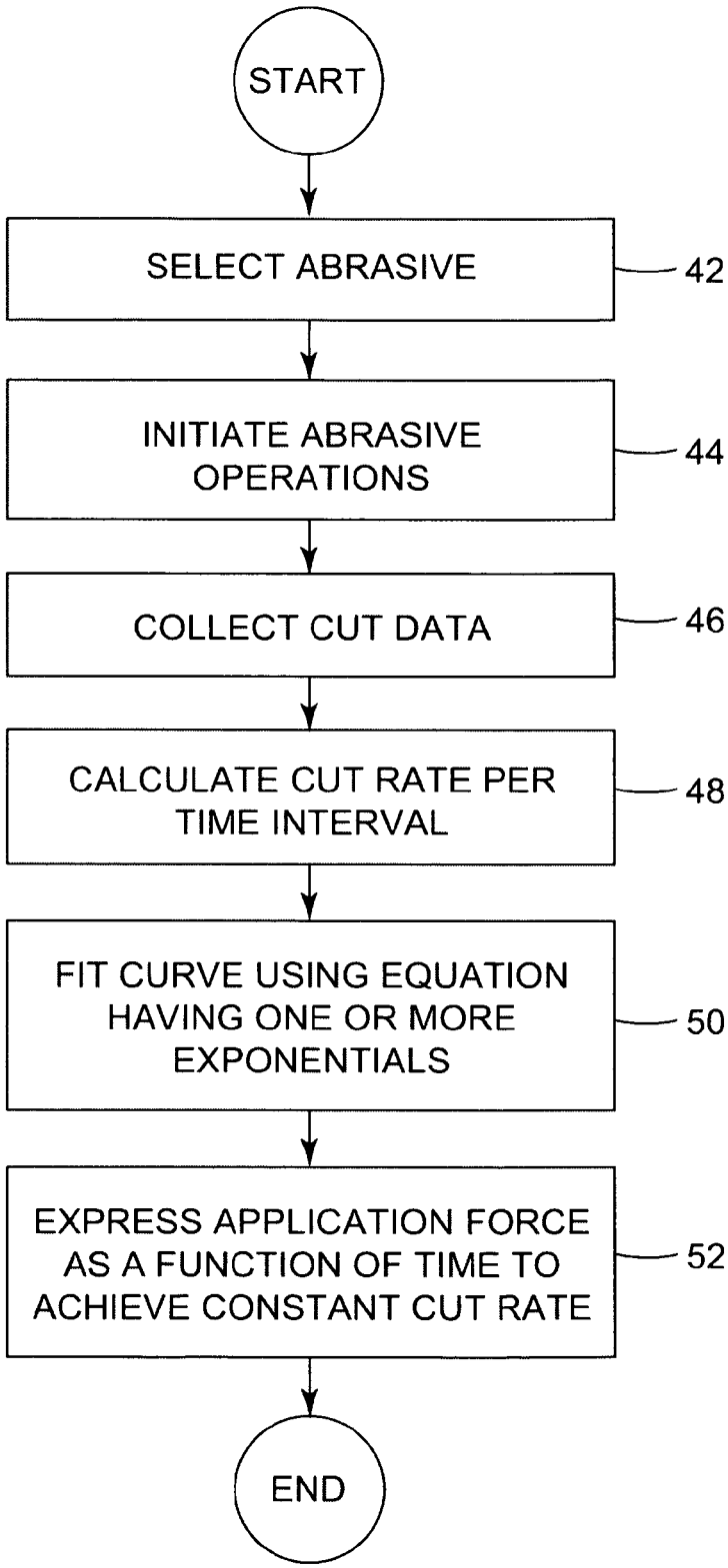
FIG. 3 is a flowchart that further illustrates the process of generating the mathematical model.

FIG. 3 is a flowchart that further illustrates the process of generating an exemplary mathematical model for controlling abrasive manufacturing process 2 to achieve a substantially constant rate of cut. Although described for exemplary purposes in reference to specific mathematical equations, it is understood that the techniques are not so limited. In other words, different mathematical models may be generated using the techniques for various workpiece types, abrasive article types, process control settings, and the like.

To generate model 14, an operator, e.g., operator 18 of FIG. 1, initially selects one or more abrasive articles, e.g. abrasive article 22 (42). For exemplary purposes, the techniques will be described in reference to operator abrasive test apparatus 20. In other embodiments, however, the operator may utilize abrading machine 6 of abrasive manufacturing process 2 to generate the data.

Upon selecting the abrasive article, operator 18 controls abrasive test apparatus 20 to initiate a series of one or more abrasive operations (44). For example, operator 18 directs abrasive test apparatus 20 to apply abrasive article 22 to workpiece 30 using a constant force ($F_C$) for a test abrading period. Depending on the types of abrasive article and workpiece being tested, the abrading period may range from a few minutes to many hours or even days.

During the test abrading period, operator 18 collects cut data at various intervals (54). The data typically indicates the total amount of material from the initial application of the abrasive article to the point of measurement. The intervals may be fixed, or may vary based on the length of time abrasive article 22 has been applied to workpiece 30. For example, logarithmically increasing time intervals may be used to record the amount of material removed from workpiece 30, as the cut rate of abrasive article 22 may generally reduce exponentially over the abrading period when applied at a constant force ($F_C$).

The collected cut data can be used to calculate an amount of material removed during each of the intervals, which can be used to determine the cut rate achieved by abrasive article 22 during the interval (55). For example, a cut rate per unit time can be determined for each interval by dividing the amount of material removed during the corresponding time interval by the amount of time for the interval. An estimate of the cut rate for time interval N can then be calculated by computing an the cut rate between time intervals N and N−1 and between time intervals N and N+1, and taking the average of the two numbers.

For example, the following table illustrates a portion of example cut data measured from abrasive test apparatus 20:

TABLE 1

| Interval | Time | Total Cut |
|---|---|---|
| 5 | 40 | 164.8 |
| 6 | 50 | 196.7 |
| 7 | 60 | 225.6 |

In the above example, the cut rate (R) for interval N=6 can be calculated as follows:

$$R_6 = \frac{1}{2}\left(\frac{196.7-164.8}{50-40} + \frac{225.6-196.7}{60-50}\right) = 3.04 \quad (1)$$

Figure 4:
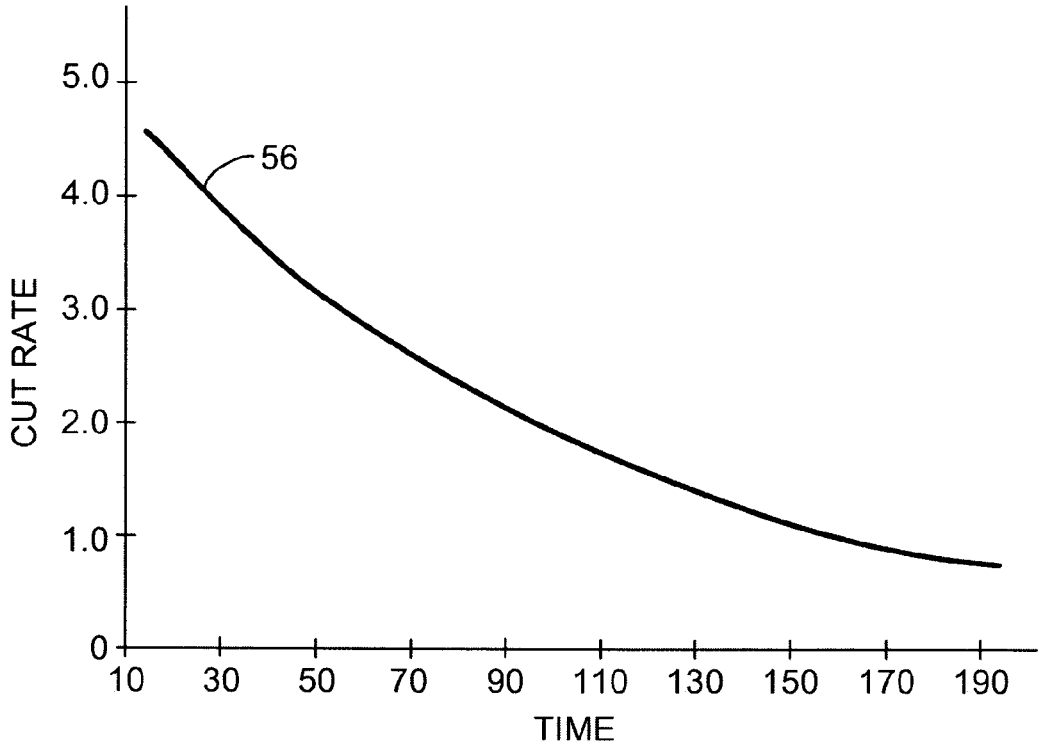
FIG. 4 is a graph that illustrates exemplary cut rate data that reduces over time along a single exponential.
Figure 5:
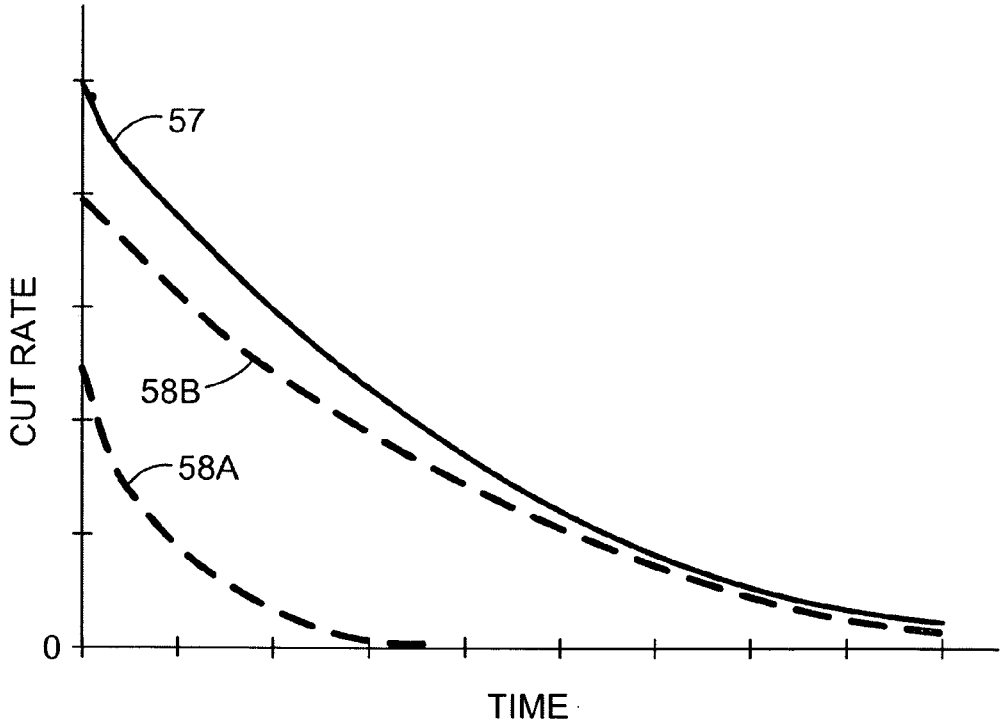
FIG. 5 is a graph that illustrates exemplary cut rate data that can be more accurately represented with a fitted curve that is a sum of two exponential components.

Next, a curve can be fit, e.g., via computer 12, to the calculated cut rate data (50). In some cases, the cut rate data indicates a decrease in cut rate over time that follows a single exponential curve. FIG. 4, for example, is a graph that illustrates exemplary cut rate data that reduces over time along a single exponential 56. More commonly, the cut rate data is better matched by the sum of two or more exponentials. FIG. 5 is a graph that illustrates exemplary cut rate data that can be more accurately represented with a fitted curve 57 that is a sum of exponentials 58A and 58B. More precisely, the cut rate (R) can be mathematically represented as follows:

$$R = R_1 \times e^{-t/T_1} + R_2 \times e^{-t/T_2}. \quad (2)$$

In equation 2, $R_1$ and $R_2$ are constants set according to an initial cut rate for the abrasive article 22. In particular, $R_1+R_2$ equals the initial cut rate for abrasive article 22, i.e., the y-intercept in FIG. 5. Further, t equals a length of time that the abrasive article 22 has been applied to the workpiece 30, $T_1$ and $T_2$ are time constants, and e represents the base commonly used for natural logarithms.

In some processes the cut rate of an abrasive type will decline as a single exponential. In equation 2, $R_2$ would be zero. In such a case, equation 2 can be transformed into a linear equation by taking the natural log, as follows:

$$\mathrm{Ln}(R) = \mathrm{Ln}(R_1) + \left(\frac{-1}{T_1}\right) \times t. \quad (3)$$

In this format, the slope (m) of the equation 3 is defined as $$m = \left(\frac{-1}{T_1}\right),$$

and the y-intercept (b) is defined as $b=\mathrm{Ln}(R_1)$. Actual cut rate data may include some intrinsic variability due to the process and the measurements. A best fit line to the linear equation can be found by using the well known least squares method. This method will minimize the sum of the squares of the residual errors of the data subtracted from the fitted line. More specifically, the least squares method can be used to find a slope and intercept for the line. $R_1$ can then be found by taking the anti-log of the intercept and the time constant, $T_1$, will be the negative inverse of the slope.

More commonly, the cut rate of an abrasive will be better fit by the sum of two exponential curves as in equation 2 where both $R_1$ and $R_2$ are non-zero. The exponential components of equation 2 can be found by an iterative process. In particular, a least square fit can be performed, e.g., via computer 12 of FIG. 1, using the slope (m) and the y-intercept (b) to estimate the first slowly-declining exponential 58B. This can be done by examining the data and estimating where the fast declining exponential curve, 58A, has become insignificant and using only the data after this point. The resulting equation having a single exponential component can be subtracted from the cut rate data at each interval to yield residual data for each interval. In like manner, the second exponential component 58A that rapidly goes to zero can be calculated from this residual data using a least squares analysis. This second exponential component can then be subtracted from the original cut data at each interval to provide a more accurate estimate of the first exponential equation. This process can be repeated, i.e., more accurate estimates for the exponential components can be repeatedly calculated, until the residual falls before a predetermined threshold. The number of data points included in the estimates of the exponential components can be changed to reduce or minimize a standard deviation for the final residual at each interval. Other techniques can be used to fit equation 2 to the data. Data from several samples of an abrasive type may be averaged to find an equation that on average gives a good fit to cut rate data for the abrasive type.

Upon resolving equation 2 as described, model 14 can be extended to express an application force (F) of abrasive article 22 needed to achieve a controlled cut rate during the abrading period (52). In other words, the above equations have been derived to express cut rate of abrasive article 22 over time when a constant force ($F_C$) is applied. From this relationship, a mathematical expression can be derived for the application force necessary to achieve a controlled cut rate at any point within the abrading period. For example, a mathematical expression can be derived for the application force of abrasive article 22 to workpiece 30 as a function of a target constant cut rate and a length of time that the abrasive article has been applied to the workpiece.

Based on experiment, it was determined that $R_1$ and $R_2$ of equation 2 increase with the application force. The experiment tested several abrasive articles of one type, where each article was tested at a constant force through its life. A different force was used for each article to observe how the constants of equation 2 varied with force. The experiment showed that the time constants, $T_1$ and $T_2$, did not change when different forces were used.

The variation of how the cut rate of a single abrasive article changed with the application of force was also observed. The experiment was done in such a manner that the effect of the wear of the abrasive during the experiment was negated. The abrasive was first used so that the cut rate had been reduced by wear to the point that the contribution of the fast declining exponential 58A was negligible. For example, after two or three time constants of the fast declining exponential. The cut rate was then changing at a slower rate. The abrasive was then tested at a sequence of monotonically increasing forces and used for a sufficient time period that the cut rate could be measured with some degree of accuracy. Long test periods are undesirable as the abrasive will wear during the test. The increase in force was stopped at a peak force and then tested with monotonically decreasing forces of the same magnitude that was used when the force was increasing. The cut rate values at each force level were averaged. The cut rate was only measured once at the highest force level. For example, the following sequence of forces could be used: 20, 30, 40, 30, and 20 newtons. The average state of wear would be that which existed at the middle of the test at 40 newtons. Averaging the cut rate measurements at 20 and 30 newtons would give a good estimate of what the cut rate would have been at each force if the abrasive did not wear at all during this test.

Experiments showed that the averaged cut rate data could be well fitted to a straight line by the least squares method. The line was found to have a non-zero intercept. Further experiments showed that the cut rate at different states of wear could be fitted to a series of straight lines that had different slopes but the same non-zero intercept. The non-zero intercept is an extrapolation of the cut rate outside of the working range of the abrasive. It is a mathematical construct that aids in calculating the cut rate within the working range of the abrasive. The working range of the abrasive is the range of forces with which the abrasive effectively cuts the workpiece. At low forces, below the working range, the abrasive is ineffective at cutting the workpiece. At high forces, above the working range, the abrasive or workpiece is damaged.

With the equations of how the cut rate of an abrasive article changes thought its life at constant force, and how the cut rate changes with force at fixed point in an abrasive articles life, a model of how to achieve a constant rate of cut by varying the force can be found. First, a variable G was defined such that:

$$R(t)=G(t)\times F+I, \tag{4}$$

where R is the grinding rate, F is the force, and I is the y-intercept from the measurement of cut rate vs. force as described above.

Moreover, G(t) is a function that expresses cut rate per unit force as a function of time. It is independent of the application force, and can be determined by measuring R(t) at a fixed force $F_{Fixed}$ as follows:

$$G(t) = \frac{R(t) - I}{F_{Fixed}}. \tag{5}$$

Next, a pseudo force F' can be defined such that:

$$R(t)=G(t)\times F'. \tag{6}$$

Accordingly, the following equations can be derived:

$$F'\times G(t)=F\times G(t)+I, \text{ and} \tag{7}$$

$$F' = F + \frac{I}{G(t)}. \tag{8}$$

In equation 8, the second term is independent of force as I is a constant. Consequently, a constant rate of cut at $R_C$ can be defined, which represents a desired level of cut independent of time:

$$R_c = G(t)\times F'(t) = G(t)\times\left[F(t) + \frac{I}{G(t)}\right] = G(t)\times F(t) + I, \tag{9}$$

which can be written as:

$$F(t) = \frac{R_c - I}{G(t)}. \tag{10}$$

Equation 10 expresses the application force as a function of time to achieve a target constant rate of cut. Equations 10 and equation 3 can be combined:

$$F(t) = \left[\frac{R_c - I}{R_1 e^{-t/T_1} + R_2 e^{-t/T_2} - I}\right]\times F_c. \tag{11}$$

where $R_C$ represents the target constant cut rate during the abrading period, $R_1$ and $R_2$ are constants set according to an initial cut rate for the abrasive article, $F_C$ represents the constant force used to determine equation 2, and I represents the y-intercept value from the measurement of cut rate vs. force. The techniques described herein can be applied to a variety of abrasive articles and abrasive manufacturing processes. For example, the techniques may readily be applied to abrasive articles where the cut rate at a moment in the life of the article is a function, e.g., linear, to the applied normal force.

EXAMPLE 1

For purposes of example, the cut rate of a silicon carbide abrasive article was measured when applied to a plastic lens on a lens polishing machine. Specifically, the lens polishing machine was a Gerber Optical Apex machine manufactured by Gerber Coburn Optical, Inc. of South Windsor, Conn. The polycarbonate lens was a 76 mm SFSV PDQ B4.25 lens from Gentex Optics of Dudley, Mass. The silicon carbide abrasive was a P280 3M734 abrasive from 3M Company of St. Paul, Minn.

For the test, the abrasive was cut into the form of a 7-petal 76 mm daisy. The lens polishing machine was modified by replacing the spring loaded single acting air cylinders with double acting cylinders to provide a more consistent force as the lens wore down. Tap water was filtered using a 2 μm filter, and was used to wash away the swarf removed during the grinding process. The first tests measured the linearity of the cut rate vs. force and found the intercept, or extrapolated cut rate at zero force, was essentially constant. The following results were obtained over a number of twenty second abrasive tests:

TABLE 2

| Force | $Average_1$ | $Average_2$ | $Average_{3,1}$ | $Average_{3,2}$ | $Average_{3,3}$ |
|---|---|---|---|---|---|
| 6775 | 30.5 | 28.5 | 28.0 | 18.0 | 9.5 |
| 8656 | 45.5 | 44.0 | 39.0 | 24.5 | 16.5 |
| 10537 | 57.5 | 53.5 | 52.0 | 30.0 | 22.0 |
| 12418 | 72.0 | 67.0 | 67.0 | 43.0 | 29.5 |
| 14299 | 90.0 | 84.0 | 79.0 | 55.0 | 40.0 |
| Slope | 0.00774 | 0.00712 | 0.00691 | 0.00492 | 0.00393 |
| Y-intercept | −22.4 | −19.7 | −19.8 | −17.7 | −18.0 |
| r | .998 | .996 | .999 | .984 | .993 |

The linearity test was repeated with three abrasive daisies ($Average_1$, $Average_2$, $Average_3$)and after various amount of wear. The third abrasive daisy was tested three times ($Average_{3-1}$, $Average_{3-2}$, $Average_{3-3}$). The normal forces (column 1, rows 2-6) used during the test are listed in grams, and the measured cut (columns 2-6) is listed in microns. As the data indicated the cut rate of the abrasive article had changed during the test, average cut rates at each force level were computed. Rows 7 and 8 list the slope and y-intercept calculated for the data. Finally, row 9 lists a "correlation coefficient" r, which is a statistical measure of the linearity of the data. The closer r is to 1, the better a straight line fits the averaged data. Twenty second tests were used to have sufficient cut to be accurately measured. The intercept was found to average −20 microns for the 20 second tests or −1 micron per second.

Next, the test was continued to characterize the exponential decay in the cut rate using several different forces. The data measured while using a constant application force of 9283 grams is illustrated in the following table:

TABLE 3

| Time | Cumulative Cut | Cut Rate |
|---|---|---|
| 0 | 0 | N/A |
| 10 | 37 | 4.05 |
| 20 | 81 | 3.80 |
| 30 | 113 | 3.35 |
| 40 | 148 | 3.23 |
| 60 | 207 | 2.75 |
| 80 | 258 | 2.5 |
| 100 | 307 | 2.38 |
| 120 | 353 | 2.18 |
| 150 | 415 | 1.95 |
| 180 | 470 | 1.78 |
| 210 | 522 | 1.65 |
| 240 | 569 | 1.46 |
| 280 | 623 | 1.34 |
| 320 | 676 | 1.28 |
| 360 | 725 | 1.18 |
| 400 | 770 | 1.06 |
| 440 | 810 | 0.98 |
| 480 | 848 | 0.88 |
| 540 | 896 | 0.80 |
| 600 | 944 | 0.73 |
| 660 | 984 | 0.63 |
| 720 | 1019 | 0.58 |
| 780 | 1053 | N/A |

Column 1 lists the time interval within the test abrading period in seconds. Column 2 lists the cumulative cut for the test abrasive process. Column three lists an averaged cut rate calculated as described above. Based on the illustrated data, the constants $R_1$, $R_2$, and the time constants $T_1$ and T2 were determined. This was repeated at several different forces and the constants of equation 2 were determined for each force, as indicated in the following table:

TABLE 4

| Force | R1 | T1 | R2 | T2 |
|---|---|---|---|---|
| 5521 | 1.91 | 519 | 1.35 | 21 |
| 8217 | 2.84 | 503 | 1.28 | 31 |
| 9283 | 2.55 | 499 | 1.84 | 54 |
| 10411 | 3.11 | 606 | 2.82 | 25 |
| 13044 | 3.62 | 516 | 2.47 | 31 |
| Average | 2.81 | 528 | 1.95 | 32 |
| STD | 23 | 8 | 35 | 39 |

In Table 4, columns 2-5, rows 2-6 lists constants derived for the normal forces used during the test. Row 7 and row 8 list the averages and standard deviations for the constants, respectively.

Equation 9 was then used to compute a normal application force as a function of time that would achieve a substantially constant cut rate based on the above-described data:

$$F(t) = \left[\frac{1.5\ \mu m/sec + 1.0\ \mu m/sec}{2.55\ \mu m/sec \times e^{-t/528\ sec} + 1.84\ \mu m/sec \times e^{-t/32\ sec} + 1.0\ \mu m/sec}\right] \times 9283\ g. \quad (12)$$

In particular, the average time constants listed in Table 4 were used, and R1 and R2 were derived from the data in Table 3. The intercept I=-1 μm/sec was derived from the data in Table 2. The application force was selected at 9283 grams, as listed in Table 4. An arbitrary target constant cut rate ($R_C$) was selected to be 1.5 μm/sec. The following table lists a portion of data that can be computed from the equation:

TABLE 5

| Time | Force | Avg. Force | Total Cut | Cut Rate |
|---|---|---|---|---|
| 0 | 4306 | N/A | 0 | N/A |
| 10 | 4783 | 4544 | 26 | 2.45 |
| 20 | 5220 | 5001 | 49 | 2.25 |
| 40 | 5955 | 5587 | 93 | 2.43 |
| 60 | 6513 | 6234 | 146 | 2.51 |
| 100 | 7268 | 6890 | 241 | 2.36 |
| 140 | 7787 | 7527 | 335 | 2.31 |
| 200 | 8440 | 8114 | 471 | 2.20 |
| 260 | 9069 | 8754 | 599 | 2.11 |
| 340 | 9920 | 9495 | 766 | 2.05 |
| 420 | 10789 | 10355 | 927 | 2.00 |
| 540 | 12106 | 11488 | 1165 | 2.05 |
| 660 | 13410 | 12758 | 1420 | 2.10 |
| 780 | 14669 | 14040 | 1668 | 2.11 |
| 900 | 15855 | 15262 | 1926 | 2.05 |

Column 2 illustrates the predicted values for the normal application force necessary to achieve a substantially constant rate of cut with the abrasive article, e.g., abrasive article 8 of FIG. 1. Column 5 illustrates the predicted cut rate over each interval. As illustrated in Table 5, the cut rate remains substantially constant, e.g., less than a twenty or thirty percent variance. The average cut rate is about 2.2 μm/sec, which is higher than the desired rate of 1.5 μm/sec throughout the entire abrading period. Moreover, the variance may be reduced by taking the average of more data to determine an average $R_1$ and $R_2$. For example, variance of less than 10%, or even 5% or less may be achieved throughout the duration of the abrading period.

Figure 6:
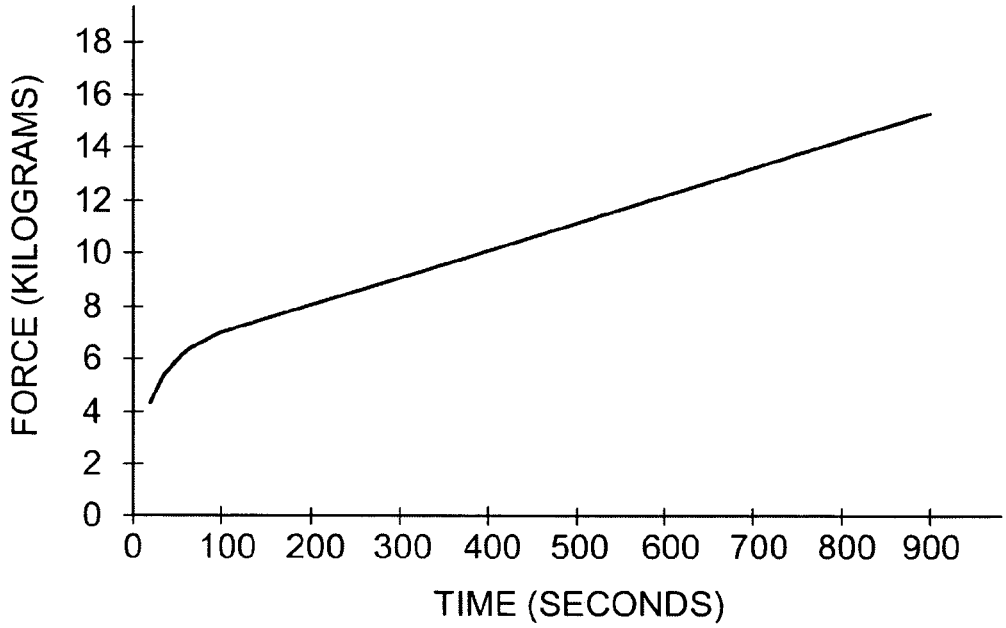
FIG. 6 is a graph that illustrates predicted application force over an abrading period to achieve the substantial rate of cut.
Figure 7:
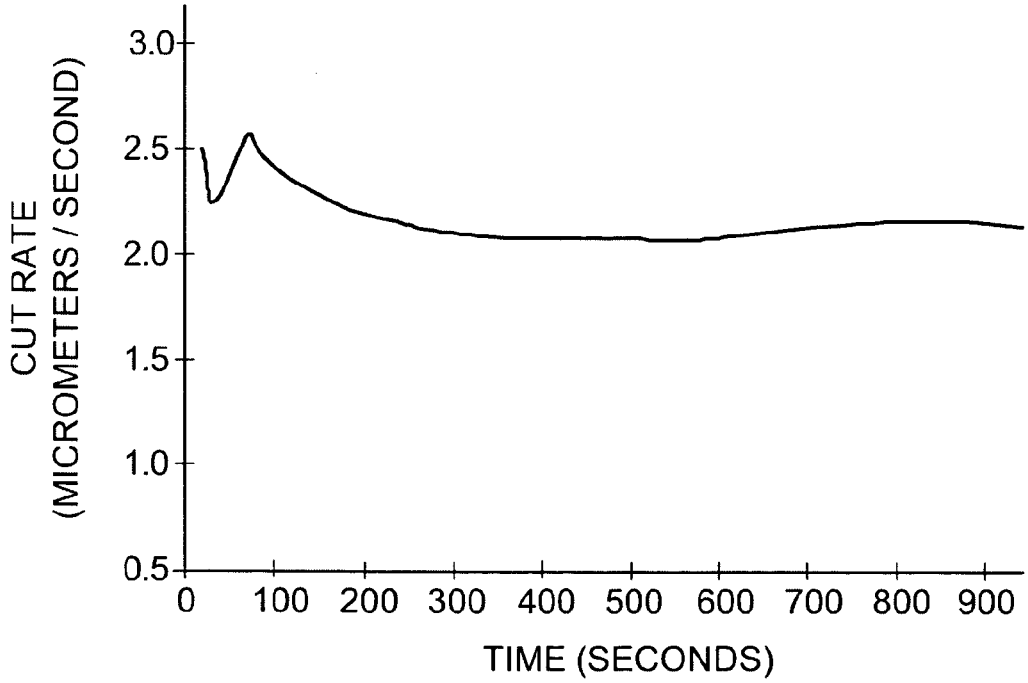
FIG. 7 is a graph that illustrates a predicted constant cut rate over the abrading period.

FIG. 6 is a graph illustrating the predicted force of Table 5 over the abrading period to achieve the substantial rate of cut. FIG. 7 is a graph that illustrates the predicted constant cut rate over the abrading period. As can be seen by FIG. 7, the cut rate of the abrasive article remains substantially constant during the abrading period as the application force is varied.

EXAMPLE 2

As illustrated in Example 1, application force of abrasive article can be computed as a process control variable. As another example, time of abrasion can also be computed from the open-loop model an used to control the amount of cut of a workpiece. In this example the same workpiece type, abrasive type, and machine of Example 1 were used. In this example a model of the abrasive was found by averaging the rate and time constants from three samples of the abrasive at a constant force. The force was set at 10,536 grams.

During the experiment, the following data was taken:

TABLE 6

| Time (second) | Sample 1, cumulative cut (microns) | Sample 2, cumulative cut (microns) | Sample 3, cumulative cut (microns) |
|---|---|---|---|
| 0 | 0 | 0 | 0 |
| 10 | 48 | 54 | 51 |
| 20 | 90 | 96 | 102 |
| 30 | 130 | 135 | 142 |
| 40 | 167 | 172 | 180 |
| 60 | 234 | 237 | 247 |
| 80 | 297 | 297 | 312 |
| 100 | 354 | 355 | 369 |
| 120 | 410 | 409 | 427 |
| 150 | 488 | 481 | 508 |
| 180 | 559 | 551 | 582 |
| 210 | 626 | 613 | 649 |
| 240 | 689 | 674 | 722 |
| 280 | 768 | 748 | 802 |
| 320 | 841 | 815 | 880 |
| 360 | 909 | 877 | 956 |
| 400 | 971 | 939 | 1024 |
| 460 | 1056 | 1020 | 1121 |
| 520 | 1128 | 1094 | 1205 |
| 580 | 1195 | 1165 | 1281 |
| 640 | 1253 | 1228 | 1349 |

The abrasive cut rate was modeled by the sum of two exponential terms as previously described. The constants from each of the three samples were averaged to determine an average model for the process. This is shown in the following table:

TABLE 7

| | $R_1$ | $T_1$ | $R_2$ | $T_2$ |
|---|---|---|---|---|
| Sample 1 | 3.395 | 484.8 | 1.613 | 31.17 |
| Sample 2 | 3.146 | 526.1 | 2.184 | 31.78 |
| Sample 3 | 3.396 | 556.5 | 2.449 | 25.98 |
| Average | 3.313 | 522.5 | 2.082 | 29.6 |

The model was then used to determine a series of time intervals that would remove 60 microns of material from the workpiece using one abrasive article. Equation 2 was integrated to give the cumulative cut of the workpieces as a function of time.

$$C=R_1\times T_1\times(1-e^{-t/T_1})+R_2\times T_2\times(1-e^{-t/T_2}) \quad (13)$$

where C is the total removed by the abrasive article. Although this equation cannot be inverted to solve for the time, t, the time for any given cumulative cut can be found to a needed accuracy by the method of successive approximations or other similar techniqes. Programs such as Excel from Microsoft Corporation, Remond, Wash., include solver functions that can be used to find the time for a given cumulative cut. The target cut multiplied by the number of times the workpiece was abraded was used to determine the desired cumulative cut after the workpiece was abraded. Equation 13 was then used to determine the total abrading time. The abrasion time for a specified abrading interval was found by subtracting the total abrading time for the abrasive article at the end of the previous abrading interval from the total time at the end of the specified interval.

A workpiece was the abraded for a length of time equal to the calculated interval and the cut was measured. In this example, the force was held constant so a measurement of the change in cut with a change in force was not needed. The calculated time interval and the resulting cut from abrading for each time interval is shown in table 8.

TABLE 8

| Time interval (seconds) | Measured Cut (microns) |
|---|---|
| 12 | 68 |
| 14 | 60 |
| 16 | 61 |
| 18 | 59 |
| 19 | 61 |
| 21 | 65 |
| 22 | 66 |
| 23 | 62 |
| 24 | 63 |
| 26 | 65 |
| 27 | 67 |
| 28 | 58 |
| 30 | 68 |
| 32 | 64 |
| 34 | 70 |
| 36 | 67 |
| 39 | 66 |
| 42 | 71 |
| 46 | 70 |
| 50 | 76 |

The table shows that the cut per interval was nearly constant and was close to the target of 60 microns.

Although the example used the same workpiece, this method can be used to remove the targeted amount of material from a series of like workpieces. In other words, the methods of examples one or two could be used to control the cut of a workpiece or series of workpieces. It may be more desirable to use force control in a process where the time cannot be varied. For example, polishing a long length of sheet metal passing through a processing line may not allow for changes in the abrading time.

When discrete workpieces are abraded, it may be more desirable to vary the time. For example, the Chemical Mechanical Planarization (CMP) of semiconductor wafers uses a fixed abrasive to abrade and condition a pad used to polish the wafers with a slurry. In order to maintain a consistent process, a minimum average amount of pad needs to be removed for each wafer. The pad is commonly abraded for some time between wafers. It may be more precise to vary the conditioning time than the conditioning force. In other CMP applications, the conditioning may be done continuously. In such a case, the time of conditioning cannot be changed but the force could be changed as in example 1. When fixed time and force CMP pad conditioning is done excess pad material is removed when the pad conditioner is new and sharp. Reducing the force or time to abrade only the amount needed will extend the life of the expensive CMP pads. Use of the model may extend the life of the pad and provide a more consistent CMP process.

Figure 8:
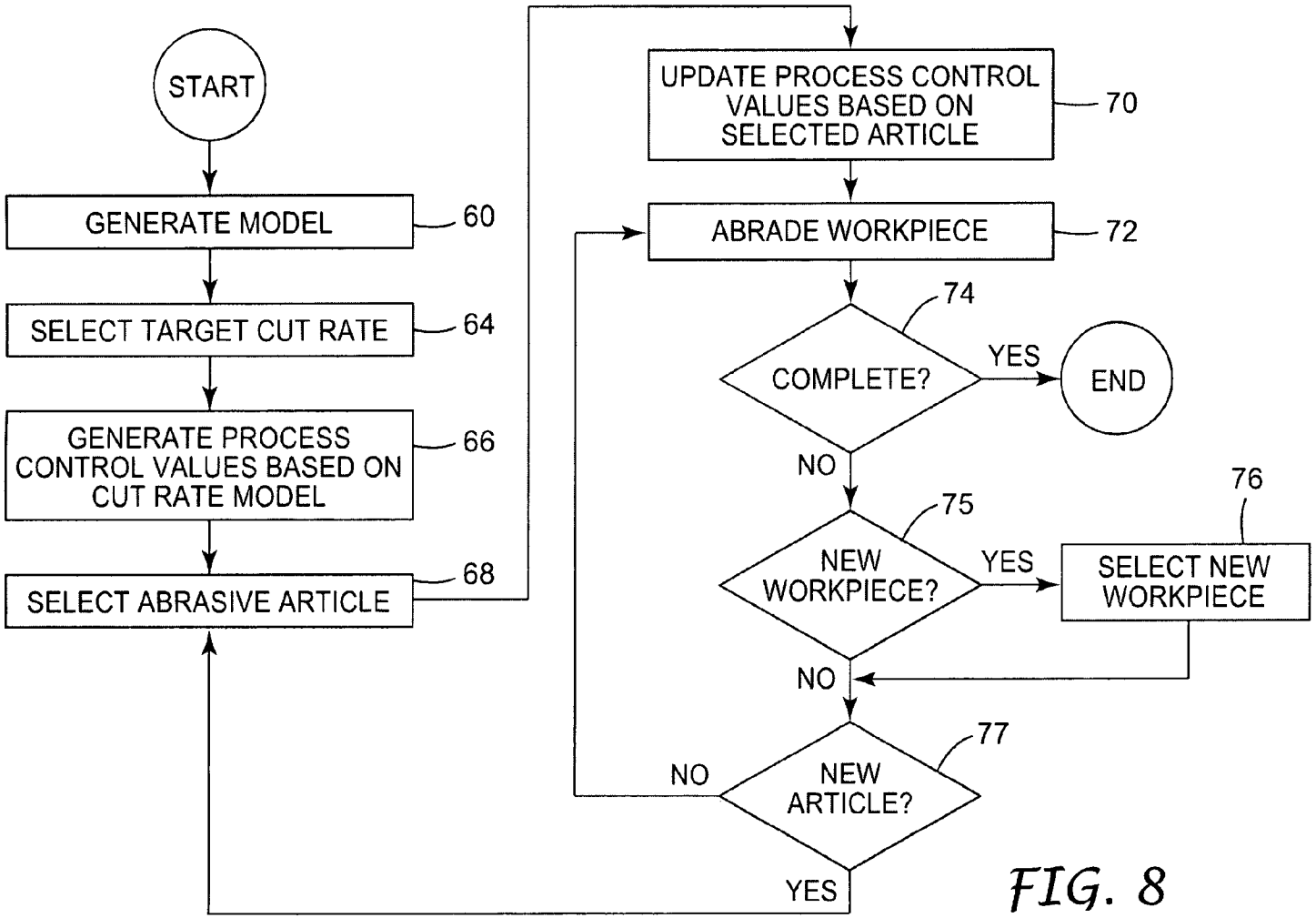
FIG. 8 is a flowchart that further illustrates the techniques of controlling abrasive manufacturing process in accordance with the model to achieve a substantially constant rate of cut.

FIG. 8 is a flowchart that further illustrates the techniques of controlling abrasive manufacturing process 2 in accordance with the model to achieve a substantially constant rate of cut. Initially, an operator, e.g., operator 18 of FIG. 1, performs a sequence of abrasive operations to generate the cut rate model, as described in detail above (60). Next, the operator selects a target constant cut rate for abrasive article 8 during the abrasive manufacturing process 2 (64). This cut rate is usually a minimum desired rate of cut. In the example 1 above, a target constant cut rate of 1.5 μm/sec was selected.

Based on the model and the desired rate of cut, computer 12 invokes model 14 to compute process control values 11, e.g., predicted normal application forces of column 3, Table 5, to achieve a substantially constant rate of cut (66). These process control values 11 are communicated to controller 4, e.g., as a lookup table, for driving control signals 5 to control abrading machine 6.

Once configured, abrasive manufacturing process 2 can be used to abrade one or more workpieces 10 during an abrading period. Initially, operator 18 selects a first abrasive article 8 (68). Controller 4 may update the process control values 11 based on the actual abrasive article 8 selected. For example, each abrasive article 8 may have some variability in cut rate. Consequently, each article may carry a performance index representative of the cut rate for the particular article, as described in further detail in U.S. patent application Ser. No. 10/115,538, to Gary M. Palmgren, filed Apr. 3, 2002, and entitled "Abrasive Articles and Methods for the Manufacture and Use of Same," the entire contents of which is incorporated by reference. Controller 4 may read the performance index, and adjust process control values 11 to compensate for the variation. If the performance index indicates the cut rate of a selected abrasive article 8 is, for example, 91% of the cut rate of the average abrasive article, then controller 4 may simply increase the application force by a multiple M=1/0.91=1.10 to achieve the desired constant cut rate.

Upon updating the process control values 11, controller 4 directs abrading machine 6 to abrade workpiece 10. In particular, controller 4 applies process control values 11 generated via model 14 to achieve a substantially controlled cut with abrasive article 8. Upon completion (74), e.g., upon abrading workpiece 10 for a pre-determined period of time, operator 18 may select a new workpiece 10 (75, 76), a new abrasive article 8 (77, 68), or both. If a new abrasive article 8 is selected, controller 4 may update process control values 11, if necessary, and controls abrading machine 6 based on a new abrading period, i.e., a new time $T_0$. If a new abrasive article 8 is not selected, controller 4 directs abrading machine 6 to abrade the newly selected workpiece 10 based on a current time within the current abrading period. In other words, the abrading period used to calculate process control values 11 may span multiple workpieces 10, thus allowing controller 4 to predict and adjust for wear of abrasive article 8 due to application to previous workpieces.

Various embodiments of the invention have been described. These and other embodiments are within the scope of the following claims.

The invention claimed is:

1. A method for controlling an abrasive process comprising:

generating an open-loop model of a cut rate of an abrasive article type when applied to workpiece type over an abrading period, wherein generating the model comprises computing the cut rate R of the abrasive article as a function of a length of time that the abrasive article has been applied to the workpiece at a substantially constant force in accordance with a first equation as follows:

$$R=R_1\times e^{-t/T_1}+R_2\times e^{-t/T_2},$$

where $R_1$ and $R_2$ are constants set according to an initial cut rate for the abrasive article, t equals a length of time that the abrasive article has been applied to the workpiece, and $T_1$ and $T_2$ are time constants; and abrading a workpiece of the workpiece type with an abrasive article of the abrasive article type in accordance with the model to achieve a substantially constant cut rate.

2. The method of claim 1, wherein abrading the workpiece further comprises:

obtaining a feedback signal representing a state of the workpiece; and applying the abrasive article to the workpiece in accordance with the open-loop model and the feedback signal.

3. The method of claim 1, wherein abrading a workpiece comprises:

applying the abrasive article against the workpiece in accordance with one or more process control variables; and adjusting at least one of the process control variables over the abrading period accordance with the model to achievc the substantially constant cut rate.

4. The method of claim 3, wherein adjusting at least one of the process control variables comprises adjusting at least one of an application force of the abrasive article against the workpiece in accordance with the model, an application velocity of the abrasive article relative to the workpiece in accordance with the model, a duration for the abrading period, and a coolant flow.

5. The method of claim 1, wherein abrading a workpiece comprises:

selecting a target cut rate;

computing values for a process control variable over the abrading period in accordance with the model using the target cut rate as an input to the model; and controlling the process control variable over the abrading period based on the computed values.

6. The method of claim 5, wherein computing values comprises computing application force values, and controlling the process control variable comprises controlling an application force at which the abrasive article is applied against the workpiece over the abrading period based on the computed values.

7. The method of claim 5, further comprising:

selecting the abrasive article from a plurality of abrasive articles; and updating the computed values for the process control variable based on selected article.

8. The method of claim 7, wherein updating the computed values comprises:

reading a performance index from the selected abrasive article; and computing the values for the process control variable using the performance index as an input to the model.

9. The method of claim 5, further comprising:

storing the computed values within a grinding machine; and abrading the workpiece with the abrasive article using the grinding machine over the abrading period in accordance with the computed values for the process control variable.

10. The method of claim 1, further comprising:

abrading a test workpiece with the abrasive article during at test abrading period;

measuring an amount of material removed from the test workpiece at intervals during the test abrading period;

generating cut rate data that represents a cut rate per unit time based on the measure amount of material; and fitting the first equation to the cut rate data to compute cut rate as a function of time.

11. The method of claim 10, generating cut rate data comprises computing an average cut rate for each interval based on the measured amount of material removed during at least two intervals.

12. The method of claim 10, further comprising:

computing a residual error based on the first equation and the cut rate data; and adjusting $T_1$ and $T_2$ based on the computed residual error.

13. The method of claim 1, wherein generating the model comprises generating the model to compute an application force of the abrasive article to the workpiece as a function of a target constant cut rate and a length of time that the abrasive article has been applied to the workpiece.

14. The method of claim 13, wherein generating model comprises generating the model to express the application force (F) in accordance with a second equation as follows:

$$F(t) = \left[\frac{R_c - I}{R_1 e^{-t/T_1} + R_2 e^{-t/T_2} - I}\right] \times F_c,$$

where $R_C$ represents the target constant cut rate during the abrading period, where $R_1$ and $R_2$ are constants set according to an initial cut rate for the abrasive article, $F_C$ represents the substantially constant force used to determine the first equation, and I represents an intercept value from the first equation at an initial time $T_0$.

15. The method of claim 1, wherein abrading the workpiece comprises abrading the workpiece with the abrasive article at achieve the substantially constant cut rate for an abrading period that exceeds at least 500 seconds.

16. The method of claim 1, wherein abrading the workpiece comprises abrading the workpiece with the abrasive article at achieve the substantially constant cut rate for an abrading period that exceeds at least one hour.

17. A system comprising:

a machine to abrade a workpiece with an abrasive article; and a controller to control the application of the abrasive article to the workpiece by the machine in accordance with an open-loop model to achieve a substantially constant cut rate for the abrasive article;

wherein the open-loop model comprises computing the cut rate R of the abrasive article as a function of a length of time that the abrasive article has been applied to the workpiece at a substantially constant force in accordance with a first equation as follows:

$$R = R_1 \times e^{-t/T_1} + R_2 \times e^{-t/T_2},$$

where $R_1$ and $R_2$ are constants set according to an initial cut rate for the abrasive article, t equals a length of time that the abrasive article has been applied to the workpiece, and $T_1$ and $T_2$ are time constants.

18. The system of claim 17, wherein the controller obtains a feedback signal representing a state of the workpiece, and controls the machine to apply the abrasive article to the workpiece in accordance with the open-loop model and the feedback signal.

19. The system of claim 17, wherein the controller controls the machine in accordance with one or more process control variables, and adjusts at least one of the process control variables over an abrading period to achieve the substantially constant cut-rate.

20. The system of claim 18, wherein the controller adjusts at least one of an application force of the abrasive article against the workpiece, an application velocity of the abrasive article relative to the workpiece, a duration of the abrading period, and a coolant flow.

21. The system of claim 17, wherein the controller comprises a computer-readable medium to store a set of values for a process control variable for use in controlling the machine during the abrading period.

22. The system of claim 21, wherein the set of values represent application forces and associated time intervals within the abrading period, and the controller directs the machine to apply the abrasive article against the workpiece during the abrading period in accordance with the values to achieve the substantially constant rate of cut.

23. The system of claim 21, wherein the controller updates the values for the process control variable based on a performance index associated with the abrasive article.

24. The system of claim 21, wherein the controller receives data indicating an actual cut rate of the abrasive article during the abrading period, and re-computes the values for the process control variable in real-time based on the data.

25. The system of claim 17, further comprising a computer-readable medium to store the first equation.

26. The system of claim 25, wherein the controller invokes the model for real-time computation of values for a process control variable for use by the machine when abrading the workpiece to achieve the substantially constant rate of cut.

27. The system of claim 25, further comprising a computer to generate the model and store the model on the computer-readable medium contained within the computer, wherein computer calculates values for a process control variable in accordance with the model, and communicates the values to the machine for use when abrading the workpiece to achieve the substantially constant rate of cut.

28. The system of claim 27, further comprising a user interface presented by the computer to receive a target cut rate, wherein the computer calculates the values in accordance with the model using the target cut rate as an input to the model.

29. The system of claim 27, comprising a user interface presented by the computer to receive input data indicating an amount of material removed from a test workpiece at respecting intervals during a test abrading period, wherein the computer generates the model based on the input data.

30. The system of claim 29, wherein the computer generates the model by calculating cut rate data indicating a cut rate per unit time based on the input data, and fits the first equation to the cut rate data to compute cut rate for the abrasive article as a function of time.

31. The system of claim 30, wherein the computer calculates the cut rate data by computing an average cut rate for each interval based on the measured amount of material removed during at least two intervals.

32. The system of claim 30, wherein the computer computes a residual error based on the first equation and the cut rate data; and adjusts $T_1$ and $T_2$ based on the computed residual error.

33. The system of claim 27, wherein the model represents an application force of the abrasive article to the workpiece as a function of a target constant cut rate and a length of time that the abrasive article has been applied to the workpiece.

34. The system of claim 33, wherein the model represents the application force (F) in accordance with a second equation as follows:

$$F(t) = \left[\frac{R_c - I}{R_1 e^{-t/T_1} + R_2 e^{-t/T_2} - I}\right] \times F_c,$$

where $R_C$ represents the target constant cut rate during the abrading period, where $R_1$ and $R_2$ are constants set according to an initial cut rate for the abrasive article, $F_C$ represents the substantially constant force used to determine the first equation, and I represents an intercept value from the first equation at an initial time $T_0$.

35. The system of claim 17, wherein the machine abrades the workpiece with the abrasive article at the substantially constant cut rate for an abrading period that exceeds at least 500 seconds.

36. The system of claim 17, wherein the machine abrades the workpiece with the abrasive article at the substantially constant cut rate for an abrading period that exceeds at least one hour.

37. A computer-readable medium comprising instructions to cause a programmable controller to direct a machine to abrade a workpiece with an abrasive article in accordance with an open-loop model to achieve a substantially constant cut rate for the abrasive article over an abrading period;

wherein the open-loop model comprises computing the cut rate R of the abrasive article as a function of a length of time that the abrasive article has been applied to the workpiece at a substantially constant force in accordance with a first equation as follows:

$$R = R_1 \times e^{-t/T_1} + R_2 \times e^{-t/T_2},$$

where $R_1$ and $R_2$ are constants set according to an initial cut rate for the abrasive article, t equals a length of time that the abrasive article has been applied to the workpiece, and $T_1$ and $T_2$ are time constants.

38. The computer-readable medium of claim 37, wherein the instructions cause the controller to apply the abrasive article against the workpiece in accordance with one or more process control variables, and adjusts at least one of the process control variables over the abrading period to achieve the substantially constant cut-rate.

39. The computer-readable medium of claim 37, wherein the instructions cause the controller to direct the machine during the abrading period in accordance with a set of values for a process control variable calculated using the first equation.

40. The computer-readable medium of claim 37, wherein the set of values represent application forces and associated time intervals within the abrading period, and the instructions cause the controller to direct the machine to apply the abrasive article against the workpiece during the abrading period in accordance with the values to achieve the substantially constant rate of cut.

41. The computer-readable medium of claim 39, wherein the instructions cause the controller to receive the values from a computing device that executes the model.

42. The computer-readable medium of claim 39, wherein the instructions cause the controller to invoke the model for real-time computation of the values.

43. A computer-readable medium comprising data representing an open-loop model for use by a machine to abrade a workpiece with an abrasive article to achieve a substantially constant cut rate for the abrasive article over an abrading period;

wherein the open-loop model comprises computing the cut rate R of the abrasive article as a function of a length of time that the abrasive article has been applied to the workpiece at a substantially constant force in accordance with a first equation as follows:

$$R = R_1 \times e^{-t/T_1} + R_2 \times e^{-t/T_2},$$

where $R_1$ and $R_2$ are constants set according to an initial cut rate for the abrasive article, t equals a length of time that the abrasive article has been applied to the workpiece, and $T_1$ and $T_2$ are time constants.

44. The computer-readable medium of claim 43, wherein the model represents an application force of the abrasive article to the workpiece as a function of a target constant cut rate and a length of time that the abrasive article has been applied to the workpiece.

45. The computer-readable medium of claim 44, wherein the model represents the application force (F) in accordance with a second equation as follows:

$$F(t) = \left[\frac{R_c - I}{R_1 e^{-t/T_1} + R_2 e^{-t/T_2} - I}\right] \times F_c,$$

where $R_C$ represents the target constant cut rate during the abrading period, where $R_1$ and $R_2$ are constants set according to an initial cut rate for the abrasive article, $F_C$ represents the substantially constant force used to determine the first equation, and I represents an intercept value from the first equation at an initial time $T_0$.

46. A method for controlling an abrasive process comprising:

generating an open-loop model of a cut rate of an abrasive article type when applied to a workpiece type over an abrading period, wherein generating the model comprises computing the cut rate R of the abrasive article as a function of a length of time that the abrasive article has been applied to the workpiece at a substantially constant force in accordance with a first equation as follows:

$$R = R_1 \times e^{-t/T_1} + R_2 \times e^{-t/T_2},$$

where $R_1$ and $R_2$ are constants set according to an initial cut rate for the abrasive article, t equals a length of time that the abrasive article has been applied to the workpiece, and $T_1$ and $T_2$ are time constants; and abrading a workpiece of the workpiece type with an abrasive article of the abrasive article type in accordance with the model to achieve a controlled amount of material removed from the workpiece during the abrading period.

47. The method of claim 46, wherein abrading the workpiece comprises abrading the workpiece in accordance with the model to achieve a substantially constant rate of cut during the abrading period.

48. The method of claim 46, wherein abrading the workpiece comprises abrading the workpiece in accordance with the model to remove a target amount of material from the workpiece during the abrading period.

49. A method for controlling an abrasive process comprising:

generating an open-loop model of a performance parameter of a type abrasive article type when applied to a type of semiconductor conditioning pad, wherein generating the model comprises computing the cut rate R of the abrasive article as a function of a length of time that the abrasive article has been applied to the workpiece at a substantially constant force in accordance with a first equation as follows:

$$R=R_1\times e^{-t/T_1}+R_2\times e^{-t/T_2},$$

where $R_1$ and $R_2$ are constants set according to an initial cut rate for the abrasive article, t equals a length of time that the abrasive article has been applied to the workpiece, and $T_1$ and $T_2$ are time constants;

polishing a plurality of semiconductor wafers with a conditioning pad of the conditioning pad type; and repeatedly abrading the conditioning pad with an abrasive article of the abrasive article type in accordance with the model to remove a substantially equal amount of material from the pad during each of the abradings.

50. The method of claim 49, wherein repeatedly abrading the conditioning pad comprises varying a time period for each of the abradings in accordance with the model.

51. The method of claim 49, wherein repeatedly abrading the conditioning pad comprises varying an application force of the abrasive article during the abradings in accordance with the model.

* * * * *

UNITED STATES PATENT AND TRADEMARK OFFICE

CERTIFICATE OF CORRECTION

PATENT NO. : 7,089,081 B2 
APPLICATION NO. : 10/355659
DATED : August 8, 2006
INVENTOR(S) : Gary M. Palmgren It is certified that error appears in the above-identified patent and that said Letters Patent is hereby corrected as shown below:

Title Page
Item (56) References Cited, U.S. PATENT DOCUMENTS, Page 2
Delete "6,475,253 B1" and insert --6,475,253 B2--
Delete "6,488,575 B1" and insert --6,488,575 B2--
Delete "6,564,116 B1" and insert --6,564,116 B2--
Delete "6,612,917 B1" and insert --6,612,917 B2--

Title Page
Item (56) References Cited, FOREIGN PATENT DOCUMENTS, Page 2 Please add the following reference that was considered by the Examiner but does not appear on the printed patent:

--WO WO 00/59678 10/2000--

Column 11
Line 64, delete "T2" and insert --$T_2$--

Column 12
Line 29, delete "R1 and R2" and insert --$R_1$ and $R_2$--

Column 13
Line 65, after "total" insert --cumulative material--

Column 14
Line 2, delete "techniqes" and insert --techniques--
Line 3, delete "Remond" and insert --Redmond--
Line 13, delete "the" and insert --then--

Column 16
Line 32, delete "achievc" and insert --achieve--

Column 17
Line 7, delete "at" and insert --a--

Column 18
Line 13, delete "cut-rate" and insert --cut rate--

UNITED STATES PATENT AND TRADEMARK OFFICE

CERTIFICATE OF CORRECTION

PATENT NO. : 7,089,081 B2
APPLICATION NO. : 10/355659
DATED : August 8, 2006
INVENTOR(S) : Gary M. Palmgren It is certified that error appears in the above-identified patent and that said Letters Patent is hereby corrected as shown below:

Column 19
Line 58, delete "cut-rate" and insert --cut rate--

Signed and Sealed this

Tenth Day of April, 2007

JON W. DUDAS
*Director of the United States Patent and Trademark Office*